US006193470B1

(12) United States Patent
Aurbeck

(10) Patent No.: US 6,193,470 B1
(45) Date of Patent: Feb. 27, 2001

(54) METHOD OF OPERATING A RADIAL COMPRESSOR SET WITH INTAKE AND DISCHARGE FLOW CONTROL

(75) Inventor: Stefan Aurbeck, Köln (DE)

(73) Assignee: Atlas Copco Energas GmbH, Cologne (DE)

( * ) Notice: Subject to any disclaimer, the term of this patent is extended or adjusted under 35 U.S.C. 154(b) by 0 days.

(21) Appl. No.: 09/221,253

(22) Filed: Dec. 28, 1998

(30) Foreign Application Priority Data

Jan. 14, 1998 (DE) ..... 198 01 041

(51) Int. Cl.[7] ..... F04B 19/24; F04B 49/00
(52) U.S. Cl. ..... 417/53; 417/19; 415/191
(58) Field of Search ..... 417/44.2, 19, 43, 417/29, 20, 32, 213, 295, 297, 298, 53; 415/17, 15, 26, 181, 191

(56) References Cited

U.S. PATENT DOCUMENTS 4,288,198 * 9/1981 Hibino et al. ..... 415/1
5,355,691 * 10/1994 Sullivan et al. ..... 62/201
5,618,160 * 4/1997 Harada et al. ..... 415/17

FOREIGN PATENT DOCUMENTS 195 96 790 9/1995 (DE) .
0 761 981 3/1997 (EP) .

* cited by examiner

*Primary Examiner*—Noah P. Kamen
*Assistant Examiner*—Mahmoud M Gimie
(74) *Attorney, Agent, or Firm*—Herbert Dubno

(57) ABSTRACT

A method of operating a radial compressor wherein the output pressure and the throughput $\dot{m}$ through a radial compressor are measured and the working point A in the operational characteristic diagram of the compressor is determined. For predetermined settings of the discharge flow control, the pump limits of the intake flow control characteristic fields are calculated in the operational characteristic diagram of the compressor. When the discharge flow control is so set that the working point falls in a working range associated with one of the pump limits and whose boundaries in the compressor operational characteristic diagram is spaced by a predetermined minimum spacing and a predetermined maximum spacing from the pump limit. When the working point A varies within this working range, only the intake flow control is adjusted. When the working point leaves the range, the discharge flow control is also adjusted.

5 Claims, 4 Drawing Sheets

METHOD OF OPERATING A RADIAL COMPRESSOR SET WITH INTAKE AND DISCHARGE FLOW CONTROL

FIELD OF THE INVENTION

My present invention relates to a method of operating a radial compressor set having a radial compressor, an adjustable intake flow control upstream of the radial compressor and a discharge flow control which is likewise adjustable and is located downstream of the radial compressor, in the case of variations in the operating points of the compressor set in the operational characteristic diagram of the radial compressor.

BACKGROUND OF THE INVENTION

Radial compressors for industrial use generally have a wide range of throughputs with excellent efficiencies under a variety of intake conditions. Radial compressors for use in the aeration of clarifier basins in waste water or sewage treatments are operated with a range of throughputs to supply the aeration devices in the clarifier basins with air. The air is generally blown into the clarifier basin from the bottom and the pressure which the air must be compressed for the delivery of a certain throughput in the aerating unit, is dependent upon the water level in the clarifier basin. During the course of the day the operating point may fluctuate because of changes in the intake temperature of the air. In addition, there are seasonal effects on the operation of the radial compressor set. As a result of these various influences, the operating point of the radial compressor in the operational characteristic diagram mapped on a graph plotted pressure versus the mass flow rate of the air may vary continuously or frequently. Furthermore, there are industrial applications of radial compressors in which the intake pressure undergoes significant fluctuations and these too can vary the operating points in such a diagram.

As a consequence, it is common to provide upstream of a radial compressor, an intake flow control and downstream of the radial compressor a discharge flow control each having a plurality of vanes and respective drives with variable output speeds or rpm. Adjustment of the discharge flow control can be effected when the compressor must cover a wide throughput range with a substantially constant isentropic compressor work. A regulation of the intake flow control can be effected when the compression ratio and/or the intake temperature significantly varies.

Neither the control of the intake flow control unit nor the control of the discharge flow control unit suffices alone to enable operation of the compressor with optimum efficiency.

When the regulation of the discharge flow control unit is combined with regulation of the intake flow control unit, there is practically an unlimited number of possible combinations for the angular positions of the vanes of the intake and discharge controllers and it is thus possible to establish a predetermined volume flow for the air to be compressed as well as a predetermined compressor work. There is, however, a problem with respect to setting an appropriate combination of vane positions in order to minimize the power consumption and thereby ensure the maximum operating efficiency of the compressor.

In a process described in the German patent document DE-A 195 06 790, attempts are made to optimize the efficiency of a radial compressor by measuring the intake temperature, the intake pressure, the discharge temperature, the discharge pressure and the throughput through the radial compressor whereby, using a calculation, the operating point can be associated with values for setting the angular positions of the vanes or blades of the intake control unit and the discharge control unit. The association is effected by means of an operational characteristic diagram stored in a computer and which contains a network of efficiency-optimizing characteristic line points. The characteristic line points are determined by empirical efforts in a series of tests on the original compressor or in models thereof. For each characteristic line and hence each of the points along such a line, a multiplicity of tests must be made in which the positions of the intake control unit and of the discharge control unit are systematically varied and the respective efficiencies of the machine are determined.

Those combinations which maximize the efficiency of the compressor are inputted as the optimum characteristic lines or characteristic line points in the operational characteristic diagram. The operational characteristic diagram and the characteristic lines must be newly determined for each radial compressor and hence the operation is expensive. Furthermore, the determination of the operational characteristic diagrams and performance characteristics requires expensive computer-based interpolation processes for associating the respective volume flows with the working points given by the compressor work and thus to establish the sort of parameter combinations. In practice, this earlier process is too expensive and therefore is not used.

From European patent document EP 0 761 981, an operation of a radial compressor with adjustable intake and discharge control units is described in which the adjustment of the intake control unit has primacy. When the adjustment of the intake control unit does not suffice to establish a stable operation of the radial compressor, the discharge control unit is additionally adjusted. Operation at an optimum efficiency over a wide regulation range is however not always ensured by this process.

OBJECTS OF THE INVENTION

It is therefore the principal object of the present invention to provide an improved process for operating a radial compressor set and which allows in a simple manner operation of the radial compressor with high efficiency over a wide control range.

Another object of this invention is to provide a method of operating a radial compressor set in which an intake flow control and a discharge flow control are respectively provided upstream and downstream of a radial compressor, whereby drawbacks of earlier systems including those described can be avoided.

SUMMARY OF THE INVENTION

These objects which will become apparent hereinafter are attained in a process for operating a radial compressor having adjustable intake and discharge flow controllers upon changes in the operating point of the radial compressor set in the operational characteristic diagram of the radial compressor mapped on a graph plotted pressure versus mass flow rate in which, firstly, the output pressure and throughput of the radial compressor are measured and the operating point in that operational characteristic diagram is determined. For predetermined positions or settings of the discharge flow controller, which can be of the vane or blade type, the pump limits of the intake control operational characteristic diagram in the compressor characteristic diagram can be calculated.

The term "pump limit" is synonymous with the surge or stability limits known in association with compressor characteristics (see for example, Chapter 19, pages 30 ff of *Handbook of Fluid Dynamics*, Victor L. Streeter, Editor-i-Chief, McGraw Hill Book Company, New York, 1961).

The discharge flow control is then so set that the operating point falls within a working range associated with one of these pump limits and whose boundaries in the compressor characteristic diagram are defined by a predetermined minimum spacing and a predetermined maximum spacing from the pump limits.

Only the intake flow control is then adjusted when the operating point varies within that working range and the discharge control unit can be adjusted in addition and thereafter when the working point leaves that range, the adjustment of the discharge control unit is effected in predetermined steps until a new operating point lies in the working range associated with a pump limit for a new discharge flow control set.

Preferably the intake flow control is included in a control circuit whereby, in accordance with a first embodiment of the invention, the output pressure as a controlled parameter is compared with a setpoint value and, upon a deviation of the output pressure from the setpoint value, the setting of the intake flow control is varied to serve as the adjustment for the control system. This embodiment of the invention has been found to be desirable when the radial compressor having a variable throughput is to be so operated that the final pressure is constant.

Another embodiment of the invention provides that the throughput, with the control parameter, be compared with a setpoint value and upon deviation of the measured throughput from the setpoint value, the position or setting of the intake flow control is varied to control the operation of the radial compressor set. In this embodiment, the throughput is maintained constant based upon the setpoint value and the isentropic compressor work is a variable parameter.

According to the process of the invention, the discharge flow control is so adjusted that the working point remains within a defined minimum and maximum spacing from the respective pump limit over the entire control range of the radial compressor. This ensures that with relatively little cost for the control system, the combination of intake and discharge flow control setting will bring the radial compressor set to nearly the thermodynamic optimal combination. The process of the invention is thus practiced with a minimum cost of the control equipment and is not subjected to limitations of known combined controls of intake and discharge flow regulators.

According to another feature of the invention, the intake temperature and the intake pressure are measured at the suction side of the radial compressor and the discharge flow control settings associated with respective pump limits in the operational characteristic diagrams of the compressor are calculated considering the measured values for the intake temperature and intake pressure. The calculations can be effected with known thermodynamic equations for isentropic or polytropic state changes. The establishment of the settings of the discharge flow control unit for the pump limits in the operational characteristic diagram of the compressor is possible in an especially simple manner.

Initially the pump limits of the intake flow control characteristic fields are obtained for the two extreme settings of the discharge flow control unit. The extreme settings are the smallest angular adjustment (MINNLA) and the largest angular setting (MAXNLA) for the vanes.

The pump limits for the extreme settings of the discharge flow control are determined preferably under standard conditions of the intake state in an experimental operation of the radial compressor, whereby in the test series the intake control is shifted from its largest angular setting to its smallest angular setting. The coordinates of the starting points $P1_{MAXNLA}$, $P1_{MINNLA}$ are determined together with the coordinates of the end points $P2_{MAXNLA}$, $P2_{MINNLA}$, for the smallest angular setting of the intake control. From these obtained values, the pump limits are determined for the intermediate settings of the discharge control by calculation in that the stretch between the starting points $P1_{MAXNLA}$, $P1_{MINNLA}$, and the end points $P2_{MAXNLA}$, $P2_{MINNLA}$, are subdivided into segments which are associated with intermediate positions of the discharge flow control and thereby the starting and end points P1, P2 of the pumping limits associated with the discharge flow control are defined. The pumping limits are established by a mathematical function tying one of the starting points to one of the end points in the compressor operational characteristic diagrams.

Advantageously the pump limits are described by linear equations in the compressor operational characteristic diagram.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
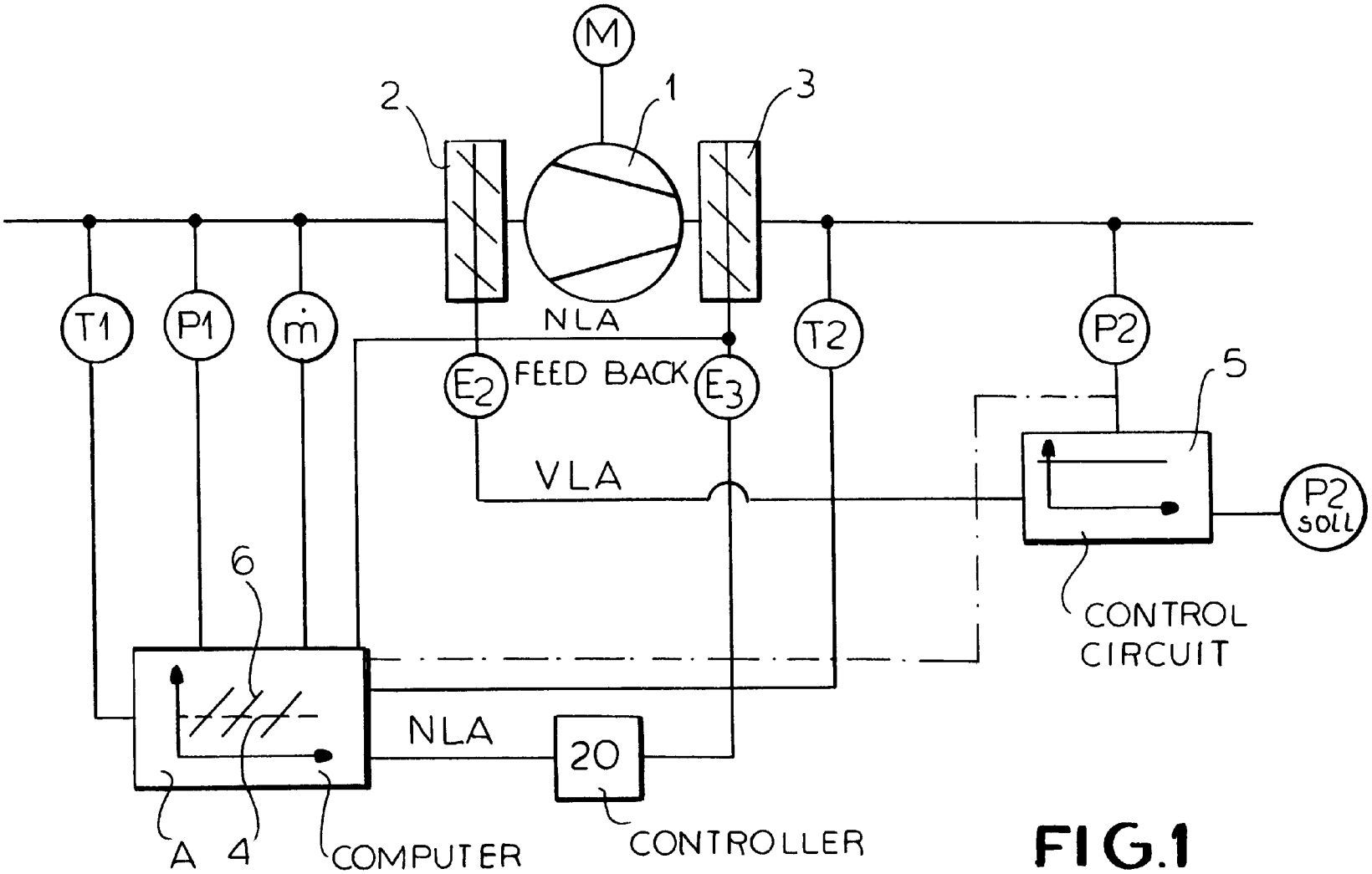
FIG. 1 is a highly simplified diagram illustrating the process of the invention.

The process of the invention is intended to control the operation of a radial compressor set with changes in the working point in a compressor operational characteristic diagram. The radial compressor is shown at 1 in FIG. 1 and is driven by a motor M. At the upstream side of the radial compressor is an intake flow control 2 whose vanes are motor-driven by an electric motor or a pneumatic effector while downstream of the compressor 1 is a discharge flow control 3 whose vanes are likewise positionable by an electric motor or a pneumatic effector. The drives are represented at $E_2$ and $E_3$, respectively, in FIG. 1.

The intake temperature T1, the discharge temperature T2, the intake pressure P1 and the output pressure P2 are measured upstream and downstream of the set 1, 2, 3 while the throughput of the radial compressor is measured in terms of the mass flow rate $\dot{m}$. Instead of the mass flow, the intake volume can be measured. The measured values T1, T2, P1, P2 and $\dot{m}$ are fed to a computer 4 which carries out the operational characteristic field calculations. The computer has a feedback from the downstream or discharge flow control 3 represented at NLA feedback and has an output NLA via a controller 20 from the computer 4, the controller having an appropriate transfer function relating the computer output to the discharge flow control setting. The intake flow control 2 is controlled by an output VIA from a control circuit 5 comparing the measured pressure P2 with a setpoint value programmed in the controller and represented at $P2_{SOLL}$. Upon a deviation of the output pressure from the setpoint, an output is provided at VLA to change the setting of the intake flow control 2 to thereby adjust the operation of the set 1, 2, 3.

Figure 2:
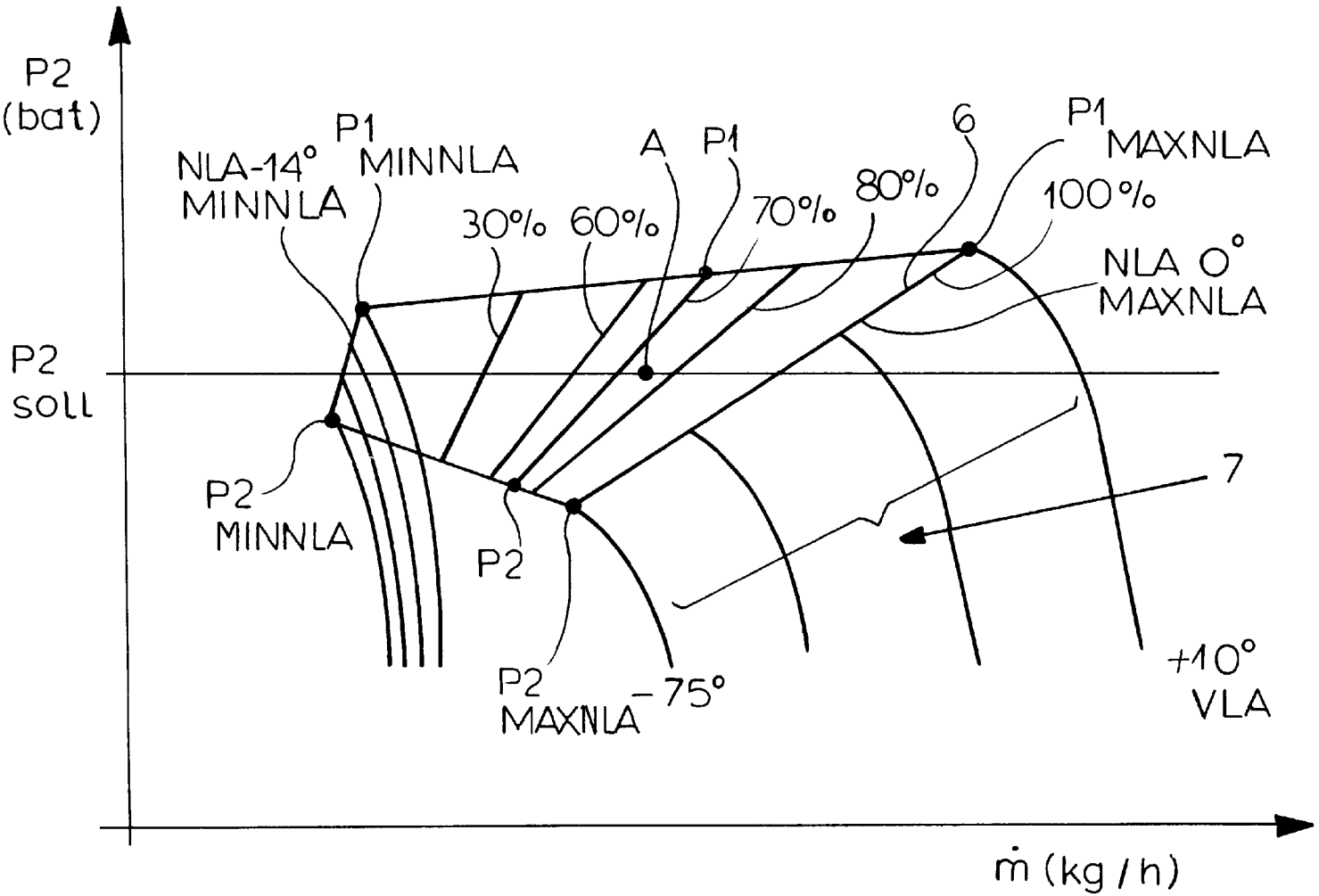
FIG. 2 is the compressor operational characteristic diagram.
Figure 3:
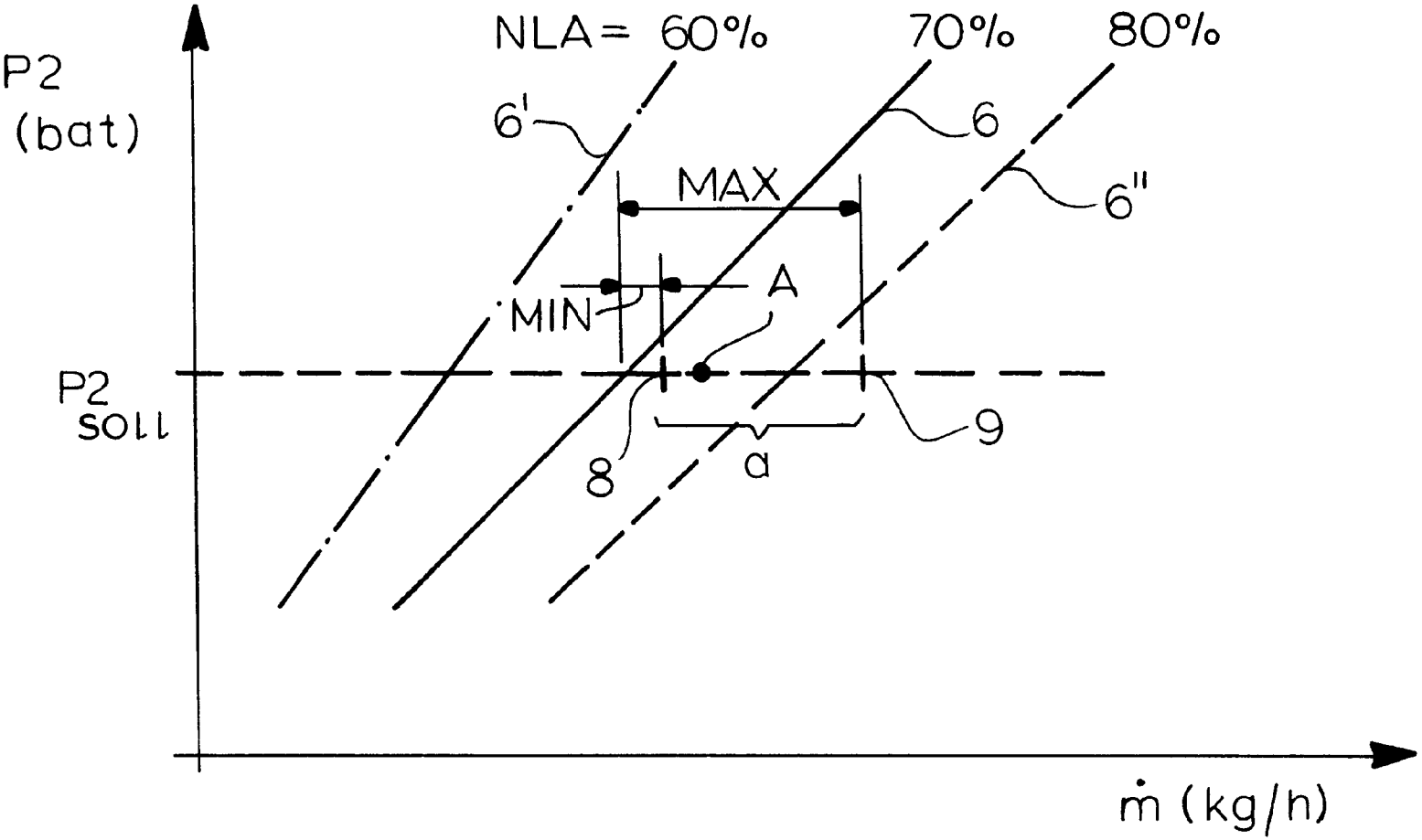
FIG. 3 is a section of the compressor characteristic diagram in the region of the working point.

The method of operating the radial compressor set will be understood in connection with the graphs of FIGS. 2 and 3. The output pressure P2 and the mass flow rate $\dot{m}$ through the radial compressor 1 are measured and the working point A in the compressor operational characteristic diagram of FIG. 2 is determined. That diagram is plotted on a graph of pressure versus mass flow rate. For predetermined settings NLA of the discharge flow control 3, the pump limits 6 of the intake flow control characteristic diagrams 7 in the compressor characteristic field are calculated. Then the discharge flow control 3 is so adjusted that the working point A falls in a working region a associated with one of the pump limits, but at a predetermined minimum spacing MIN and a predetermined maximum spacing MAX from the pump limit 6 (FIG. 3). As long as the working point A lies within the working range a and varies within this range, only the intake flow control 2 is adjusted. The intake flow control is so adjusted by the aforedescribed control circuit 5 that the output pressure P2 corresponds to a constant setpoint $P2_{SOLL}$ upon a change in the throughput $\dot{m}$.

When the working point A leaves the working range associated with a particular discharge flow control setting NLA, the discharge flow control 3 is adjusted. The adjustment of the discharge flow control 3 is effected in predetermined steps, for example in the embodiment shown in steps of 10% of the maximum setting displacement until the working point A falls within a region associated with the pump limits 6, 6'. If there is a reduction, for example, of the throughput $\dot{m}$ and the requisite safety spacing from the actual pump limit falls below the minimum value at the point 8, the discharge flow control 3 is closed down by one setting increment.

With the resetting of the discharge flow control 3, the pump limit is shifted to the left so that the spacing of the working point A to the newly applicable pump limit is thereby increased again. If the throughput $\dot{m}$ increases and the working point A passes the upper limit 9, the discharge flow control 3 is opened by one setting increment thereby shifting the pump limit to the right and the spacing of the working point A to the new pump limit 6" is reduced. The determination of the pump limits 6, 6', 6" in the compressor operaitonal characteristic diagram of FIG. 2 will be understood from the following.

The pump limits of the intake flow control characteristic fields 7 are determined in the extreme discharge flow control settings MAXNLA, MINNLA by test operation of the radial compressor 1. The determination of the pump limits are effected at standardized suction conditions. Taking into consideration the measured values for the intake temperature T1 and the intake pressure P1, the pump limits for the two extreme sets MAXNLA, MINNLA of the discharge flow control are calculated by computer. The computer matching is effected based upon the thermodynamic equations of the polytropic or isotropic set changes.

The pump limits associated with the extreme setting MAXNLA, MINNLA are described by functions, preferably by linear equations, in the operational characteristic diagram of the compressor. The coordinates of the starting points $P1_{MAXNLA}$, $P1_{MINNLA}$ for the greatest angular settings of the intake flow control and the coordinates of the end points $P2_{MAXNLA}$, $P2_{MINNLA}$ for the smallest angular settings of the intake flow control are determined. The pump limits 6, 6', 6" for the intermediate positions of the discharge flow control are then computed in the operational characteristic diagram of the compressor by subdividing the stretches between the starting points $P1_{MAXNLA}$, $P1_{MINNLA}$ and the end points $P2_{MAXNLA}$, $P2_{MINNLA}$ into segments which are associated with the intermediate positions of the discharge flow control 3. The pump limits are then mathematically calculated from the functions representing the lines connecting the starting and end points P1, P2, these lines corresponding to linear equations. The advantage of the process of the invention by comparison to a process in the art will be apparent from FIG. 4.

Figure 4:
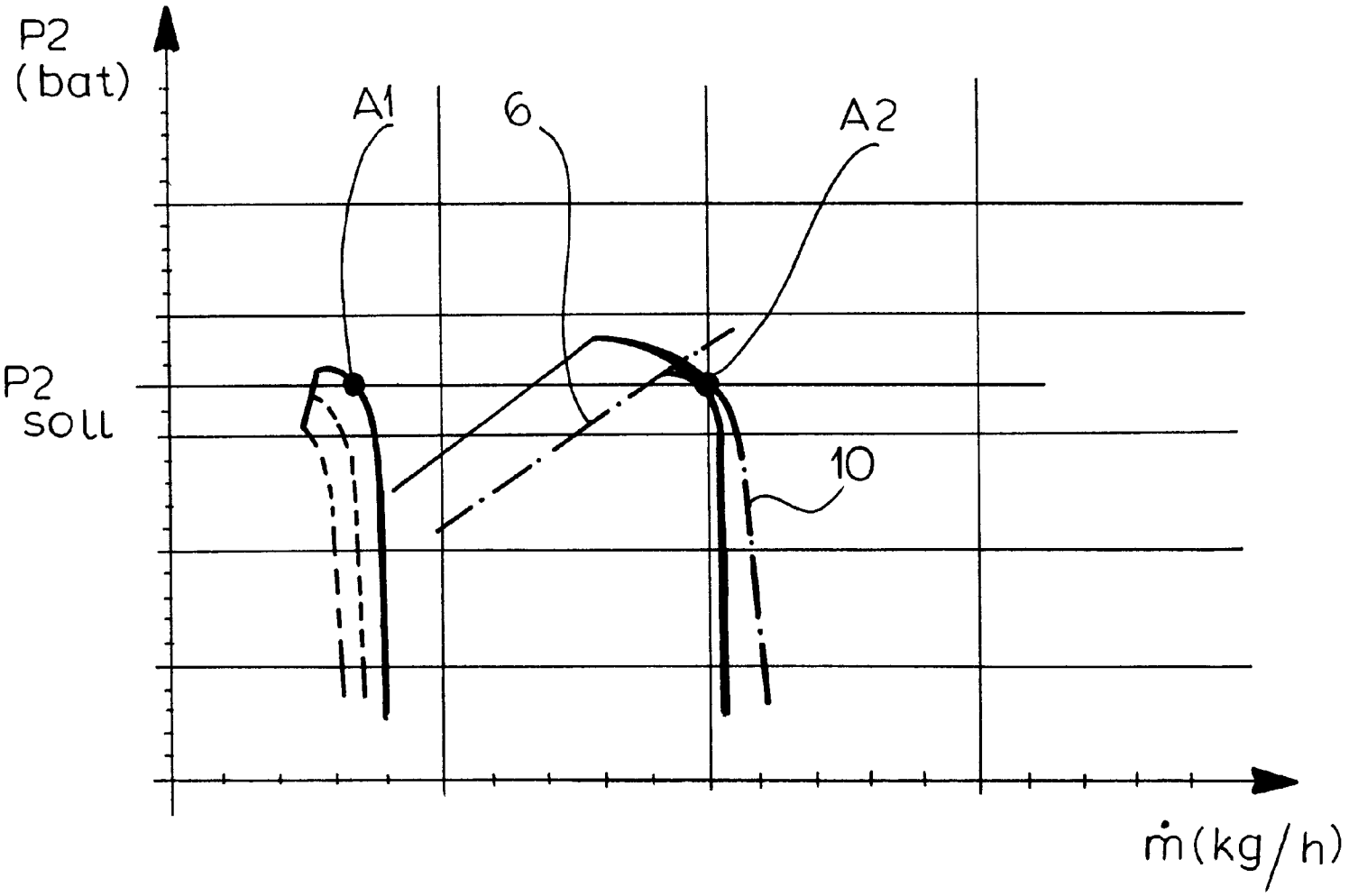
FIG. 4 is a graph comparing the process of the invention with a process in the state of the art, plotted on the compressor operational characteristic diagram.

In the prior art process the settings only of the discharge control unit 3 are varied while the intake flow control 2 remains unaltered. In FIG. 4 there is a change in the working point from A1 to A2 as a result of a change in the throughput $\dot{m}$. In the working point A1, the intake flow control has its blades or vanes at the maximum angular setting. If the setting of the intake flow control remains unchanged, the working point is clearly removed from the pump limit by a change in the throughput $\dot{m}$. The efficiency of the radial compressor is markedly reduced. When the method of the invention is used and both the discharge flow control 3 and the intake flow control 2 are newly set upon a change in the working position, the dot-dash line characteristic 10 is associated with the pump limist 6. The working point is maintained practically over the entire control range at a small effective of efficiency ensuring distance from the pump limit.

I claim:

1. A method of operating a radial compressor set having a radial compressor, an intake flow control upstream of said radial compressor and a discharge flow control downstream of said radial compressor, said method comprising the steps of:

(a) mapping an operational characteristic diagram of said radial compressor on a graph plotting pressure versus mass flow rate;

(b) measuring downstream of said set an output pressure and a throughput and determining on said diagram an operating point of said radial compressor;

(c) calculating for a plurality of given positions of said discharge flow control respective pump limits of operational characteristic fields of said discharge flow control in said operational characteristic diagram of said rdial compressor;

(d) setting said discharge flow control so that said operating point lies within a working range associated with a respective one of said pump limits in the operational characteristic field thereof and defined by a predetermined minimum distance and a predetermined maximum distance from the respective pump limit;

(e) adjusting only said intake flow control when said operating point changes within said working range; and (f) in addition to adjusting said intake flow control, adjusting said discharge flow control when said operating point leaves the working range for a particular discharge flow control setting and until a new operating point lies in the working range associated with a pump limit for a new discharge flow control setting, an intake temperature and an intake pressure being measured at a suction side of the radial compressor and the pump limits associated with the discharge flow control settings being matched by computer based upon the measured values of the intake temperature and the intake pressure.

2. The method defined in claim 1 wherein the output pressure is compared with a setpoint in a control circuit and upon deviation of the output pressure from the setpoint, a second of the intake flow controls is adjusted as the setting element for a radial compressor set.

3. The method defined in claim 1 wherein a throughput of said set serves as a control parameter and is compared with a setpoint, and upon deviation of the throughput from the setpoint, the setting of the intake flow control is varied as a control element for the radial compressor set.

4. The method defined in claim 1 whereby pump limits for the intake flow control characteristic fields for the extreme settings (MAXNLA, MINNLA) of the discharge flow control are determined, the pump limits associated with the extreme positions are described by functions in the operational characteristic diagram of the compressor and the coordinates of the starting points ($P1_{MAXNLA}$, $P1_{MINNLA}$) for the greatest angular setting of the intake flow control and the coordinates of the end points ($P2_{MAXNLA}$, $P2_{MINNLA}$) for the smallest angular setting of the intake flow control are determined and wherein the pump limits for the intermediate settings of the discharge flow control are computed in that the stretch between the starting points ($P1_{MAXNLA}$, $P1_{MINNLA}$) and the end points ($P2_{MAXNLA}$, $P2_{MINNLA}$) are subdivided into segments which are associated with the intermediate positions of the discharge flow control and define the starting and end points for the pump limits with P1, P2 associated with the discharge flow control, and the pump limits are determined by mathematical functions connecting the starting and end points (P1, P2) in the compressor operational characteristic diagram.

5. The method defined in claim 1 wherein the pump limits are described by linear equation in the operational characteristic diagram of the compressor.

* * * * *